US008660476B2

(12) United States Patent
Aoi

(10) Patent No.: US 8,660,476 B2
(45) Date of Patent: Feb. 25, 2014

(54) IMAGE FORMATION DEVICE

(75) Inventor: Yosuke Aoi, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 443 days.

(21) Appl. No.: 13/074,047

(22) Filed: Mar. 29, 2011

(65) Prior Publication Data

US 2011/0268484 A1 Nov. 3, 2011

(30) Foreign Application Priority Data

Apr. 28, 2010 (JP) ..... 2010-103458
Feb. 22, 2011 (JP) ..... 2011-035488

(51) Int. Cl.
*G03G 15/00* (2006.01)

(52) U.S. Cl.
USPC ..... 399/397; 399/364; 399/401; 271/184; 271/185

(58) Field of Classification Search
CPC ..... G03G 15/234
USPC ..... 399/364, 401, 397; 271/184, 185
See application file for complete search history.

(56) References Cited

U.S. PATENT DOCUMENTS 8,141,872 B2 3/2012 Maeda et al.
2003/0231914 A1 12/2003 Yasui
2004/0253009 A1 * 12/2004 Kitamura ..... 399/13
2005/0025544 A1 * 2/2005 Yamashita et al. ..... 399/401
2005/0207811 A1 * 9/2005 Kimura et al. ..... 399/401
2005/0244203 A1 * 11/2005 Kamiyama ..... 399/341
2009/0184466 A1 7/2009 Maeda et al.
2010/0054771 A1 * 3/2010 Miyahara et al. ..... 399/44

FOREIGN PATENT DOCUMENTS

JP H10-129912 A 5/1998
JP 2001130811 A 5/2001
JP 2002-211786 7/2002
JP 2003012207 A 1/2003
JP 2003-050528 2/2003
JP 2004-018195 1/2004
JP 2004333634 A 11/2004
JP 2005-112548 4/2005
JP 2009173367 A 8/2009
JP 2010048961 A 3/2010

OTHER PUBLICATIONS

Notification of Reasons for Rejection issued in corresponding Japanese Patent Application No. 2011-035488 dated Jul. 2, 2013.

* cited by examiner

*Primary Examiner* — Ren Yan
*Assistant Examiner* — Allister Primo
(74) *Attorney, Agent, or Firm* — Banner & Witcoff, Ltd.

(57) ABSTRACT

An image formation device is configured such that a feed roller and a discharge roller are rotated in a first direction so that the sheet is fed from the fixing unit to the discharge opening at a first speed V1, in a second direction so that the sheet is fed from the discharge opening to the diverging point at a second speed V2 if the entire sheet has reached a discharge opening side with respect to the diverging point, and the feeding speed is changed to a third speed V3 if the sheet has reached a position where it is nipped by the sheet feed rollers after the sheet was started to be fed at the second speed V2.

7 Claims, 6 Drawing Sheets

IMAGE FORMATION DEVICE

CROSS-REFERENCE TO RELATED APPLICATION

This application claims priority under 35 U.S.C. §119 from Japanese Patent Applications No. 2010-103458 filed on Apr. 28, 2010, and No. 2011-035488 filed on Feb. 22, 2011. The entire subject matters of the applications are incorporated herein by reference.

BACKGROUND

1. Technical Field

Aspects of the present invention relate to an image formation device capable of executing a duplex printing (i.e., capable of forming images on both sides of a recording sheet).

2. Related Art

Conventionally, image formation devices capable of forming images on both sides of a recording sheet are known. Among such devices, there is known a device which is configured to reverse the recording sheet bearing an image on one surface with use of a discharge roller, and feed the reversed recording sheet to an image formation unit so that an image is formed on a back side.

For such an image formation device, there is known a technique of changing a sheet feed speed when the recording sheet is reversed to a faster speed than a speed when the recording sheet is normally fed for image formation in order to increase an image formation speed as a whole.

Incidentally, in such an image formation device, a stepping motor is typically employed for controlling the sheet feed speed.

SUMMARY

When the duplex printing is performed and when a leading end of the reversed recording sheet reaches the sheet feed roller, the leading end collides the sheet feed roller. If such a collision occurs, load to a motor driving the sheet feed roller increases rapidly.

In particular, if the image formation device is configured such that the sheet feed speed is increased when the recording sheet is reversed, the load to a motor driving the sheet feed roller due to the collide of the recording sheet to the sheet feed roller is large, and a skew of the sheet may occur or the leading end portion of the recording sheet may be folded.

In addition, if the motor is a stepping motor, disorder of the motor may occur due to the impact of the collision of the recording sheet to the sheet feed roller and noises may be generated or a feeding amount of the recording sheet may become inaccurate.

If the feeding speed is reduced, the above problem will not occur. However, if the feeding speed is reduced, the number of sheets on which images are formed within a unit time period is decreased.

In consideration of the above, aspects of the invention provide an improved image formation device with which the number of the sheets on which images are formed within a unit time period is increased, with suppressing rapid increase of the load to the driving motor.

According to aspects of the invention, there is provided an image formation device, which includes a housing formed with a discharge opening trough which a sheet is discharged from the image formation device, an image formation unit configured to form an image on the sheet, a fixing unit configured to fix an image, which was transferred on the sheet, on the sheet, a sheet feed path which guides the sheet from the fixing unit to the discharge opening, a sheet feed roller arranged in the sheet feed path, a sheet discharge roller arranged at a position in the sheet feed path and between the discharge opening and the sheet feed roller, a motor configured to drive the feed roller and the discharge roller, a reverse path which is diverged from a diverging point defined at a position in the sheet feed path and between the feed roller and the fixing unit, and a controller. The controller may be configured to control the motor to rotate the feed roller and the discharge roller in a first direction so that the sheet is fed from the fixing unit to the discharge opening at a first speed V1, to control the motor to rotate the feed roller and the discharge roller in a second direction so that the sheet is fed from the discharge opening to the diverging point at a second speed V2 if the entire sheet has reached a discharge opening side with respect to the diverging point, and to change the feeding speed to a third speed V3 if the sheet has reached a position where it is nipped by the sheet feed roller after the sheet was started to be fed at the second speed V2.

According to aspects of the invention, there is also provided an image formation device having an image formation unit that forms an image on a sheet, which includes a motor configured to rotate in forward and reverse directions, a discharge roller configured to be driven by the motor to rotate in forward and reverse directions, the discharge roller feeding the sheet with an image being formed in one surface in a direction of discharged from the image formation device and thereafter feeding the sheet in a direction of introducing the sheet inside the image formation device, a reverse path that guides the sheet which is fed in the direction of introducing the sheet inside the image formation device to be directed to the image formation unit, a feed roller arranged in the reverse path and configured to feed the sheet, and a control unit configured to control the motor such that the sheet feed speed is increased after the sheet reaches the feed roller which is closest to the discharge roller, when the discharge roller is controlled to feed the sheet in the direction of introducing the sheet.

BRIEF DESCRIPTION OF THE ACCOMPANYING DRAWINGS

FIG. 1 is a cross sectional side view of an image formation device according to an embodiment of the invention.

FIG. 2 schematically shows a configuration of a sheet feed roller of the image formation device shown in FIG. 1.

DETAILED DESCRIPTION

Hereinafter, exemplary embodiments according to aspects of the present invention will be described with reference to the accompany drawings.

Figure 1:
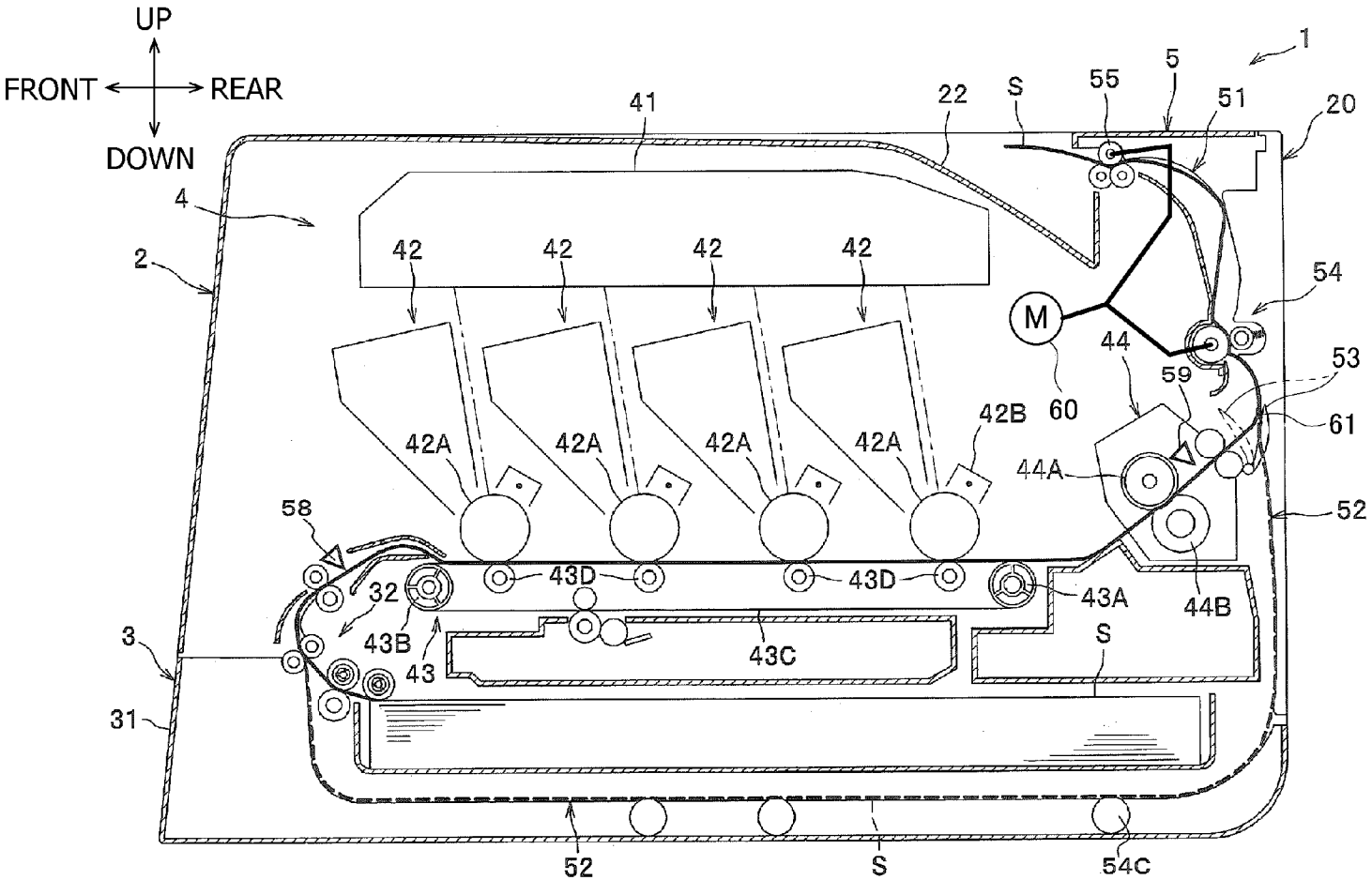

In the following description, as an exemplary embodiment, a color printer 1 will be described. In the description, directions are defined based a user of the color printer 1. That is, as indicated in FIG. 1, a left-hand side direction in FIG. 1 is defined as a "front" direction, a right-hand side direction in FIG. 1 is defined as a "rear" direction. A direction perpendicular to a plane of FIG. 1 and directed toward the user is defined as a "right" direction, while an opposite direction is defined as a "left" direction. Further, an up and down directions in FIG. 1 are defined as "up and down" directions.

The color printer 1 is configured to form (print) images on both sides of a recording sheets S, and has a sheet feed unit 3, an image formation unit 4, a discharge/reverse unit 4, which are accommodated in a housing 2. At a rear portion of the housing 2, a cover 20 is provided. The cover 20 constitutes a rear surface of the housing 2. It should be noted that the cover may be configured to be openable/closable with respect to the housing 2.

The sheet feed unit 3 is provided at a lower portion of the housing 2, and has a sheet feed tray 31, a sheet feed mechanism 32 and a sheet feed sensor 58. The recording sheets S accommodated in the sheet feed tray 31 are supplied to the image formation unit 4 by the sheet feed mechanism 32. The sheet feed sensor 58 is used for a timing controlling of the recording sheet S fed toward an image formation and the image formation operation of the image formation unit 4.

The image formation unit 4 includes an exposure unit 41, four process units 42, a transfer unit 43 and a fixing unit 44.

The exposure unit 41 is provided at an upper portion inside the housing 2. The exposure unit is typically provided with a laser source, polygonal mirror, lenses and mirrors (not shown). The exposure unit 41 emits a laser beam, which is modulated based on image data and scans a circumferential surface of each photoconductive drum 42A.

The plurality of process units 42 are arranged between the sheet feed tray 31 and the exposure unit 41 along a front-to-rear direction. Each process unit 42 has a photoconductive drum 42A, a charger 42B, a developing roller, a sheet supply roller and a toner container. The four process units 42 have substantially the same structure, and only the color of the toner accommodated in the toner container are different.

The transfer unit 43 is provided between the sheet feed tray 31 and the process units 42. The transfer unit 43 has a feeding belt 43C which is an endless belt wound around a driving roller 43A and a driven roller 43B, and four transfer rollers 43D. The feeding belt 43C is configured such that an outer surface thereof contacts the photoconductive drums 42A. On an inner side of the feeding belt 43C, the four transfer rollers 43D are arranged to face the four photoconductive drums 42A, respectively, with the feeding belt 43C located therebetween.

The fixing unit 44 is configured to fix a toner image (a developer image) transferred on a recording sheet S, and arranged on a rear side of the process unit 42. The fixing unit 44 includes a heat roller 44A, and a press roller 44B which is arranged to face the heat roller 44A and urged toward the heat roller 44A.

In the image formation unit 4, the circumferential surface of the photoconductive drum 42A is uniformly charged by the charging unit 42B. Then, the circumferential surface of the photoconductive drum 42A is exposed to the laser beam emitted by the exposure unit 41, thereby an electrostatic latent image being formed on the circumferential surface of the photoconductive drum 42A. Then, the toner contained in the toner container is supplied onto the electrostatic image of the photoconductive drum 42A via the supply roller and the developer roller. As the toner is supplied on to the electrostatic latent image formed on the circumferential surface of the photoconductive drum 42A, the latent image is developed (i.e., a toner image is formed) on the circumferential surface of the photoconductive drum 42A.

Thereafter, a recording sheet S fed from the sheet feed unit 3 to the image formation unit 4 is fed through a nip between each photoconductive drum 42A and the transfer belt 43C (corresponding transfer roller 43D), the toner images formed on the photoconductive drums 42A are sequentially transferred on the recording sheet S so that the toner images are overlaid. The recording sheet S bearing the overlaid toner images (i.e., color toner image) is fed through the nip between the heat roller 44A and the press roller 44B, and the toner image is fused and fixed onto the recording sheet S.

On the downstream side of the fixing unit 44, a sheet sensor 59 is provided, which is used to control the sheet feed timing, which will be described later.

Next, a sheet reverse feed mechanism will be described in detail.

The discharge/reverse unit 5 have a feed path 51 and reverse path 52 therein. The feed path 51 is provided with feed rollers 54 and a discharge roller 55. At a diverging point 61 where the feed path 51 and the reverse path 52 are diverging, a flapper 53 configured to be flappable (rockable) in the front/rear direction is provided.

The feed path 51 guides the recording sheet S fed from the image formation unit 4 (fixing unit 44) to upward direction. When a duplex printing is executed, the feed path 51 guides the recording sheet S to a downward direction (toward the reverse path 52). Specifically, the feed path 51 is configured to extend upward from a position in front of the flapper 53 when the flapper 53 is located at a rearward position (indicated by solid line), then the feed path 51 is curved frontward.

The reverse path 52 is a path guiding the recording sheet S toward the image formation unit when the duplex printing is executed. The reverse path 52 extends from a rear side of the flapper 53 when located at a frontward position (indicated by dotted line) to a downward position, then is curved frontward, extends, below the sheet feed tray 31, to a front position, and further is curved upward so that the reverse path 52 extends toward the sheet feed mechanism 32.

The feed rollers 54 are rotatable in forward/reverse directions. When the feed rollers 54 rotates in the forward direction, the feed rollers 54 feed the recording sheet S fed out of the fixing unit 44 toward the discharge tray 22. When the feed rollers 54 rotate in the reverse direction, the rollers 54 feed the recording sheet S toward the reverse path 52.

The discharge roller 55 is rotatable in forward/reverse directions. When the discharge roller 55 rotates in the forward direction, the discharge roller feeds the recording sheet S fed by the feed rollers 54 toward the discharge roller 20. When the discharge roller 55 rotates in the reverse direction, the discharge roller 55 introduces the recording sheet S inside the housing 2 and feeds the recording sheet S toward the feed rollers 54.

When a simplex printing (i.e., one-side printing) is executed or the duplex printing has been completed, the recording sheet S output from the image formation unit 4 (fixing unit 44) is fed along the feed path 51 from the feed rollers 54 as the feed rollers 54 rotate in the forward direction, then the recoding sheet S is discharged on the discharge tray 22 as the discharge roller 55 rotates in the forward direction.

When a duplex printing (i.e., both-side printing) is executed, the discharge roller 55 is reversely rotated after a leading end (first end) of the recording sheet S has passed through the diverging point 6 and unregistered from the feed rollers 54 and before the recording sheet S is completely discharged. With such a control, the recording sheet S is introduced in the feed path 51 again. The recording sheet S is fed within the feed path 51 from the discharge roller 55 toward the feed rollers 54. Further, by the reverse rotation of the feed rollers 54, the recording sheet S is fed to the reverse path 52 below. The flapper 53 guides the recording sheet S toward the reverse path 52 when the recording sheet S passes through the diverging point 61. Then, the recording sheet S is fed along the reverse path 52 again and directed to the image formation unit 4. Thereafter, the image formation unit 4 forms an image on a back surface of the recording sheet S, and the recording sheet S is further fed by the feed rollers 54 and discharge roller 55 and discharged on the discharge tray 22.

The feed rollers 54 include a driving roller 54A, which is connected to a stepping motor 60, and a driven roller 54B which is rotated by the driving roller 54A.

Figure 2:
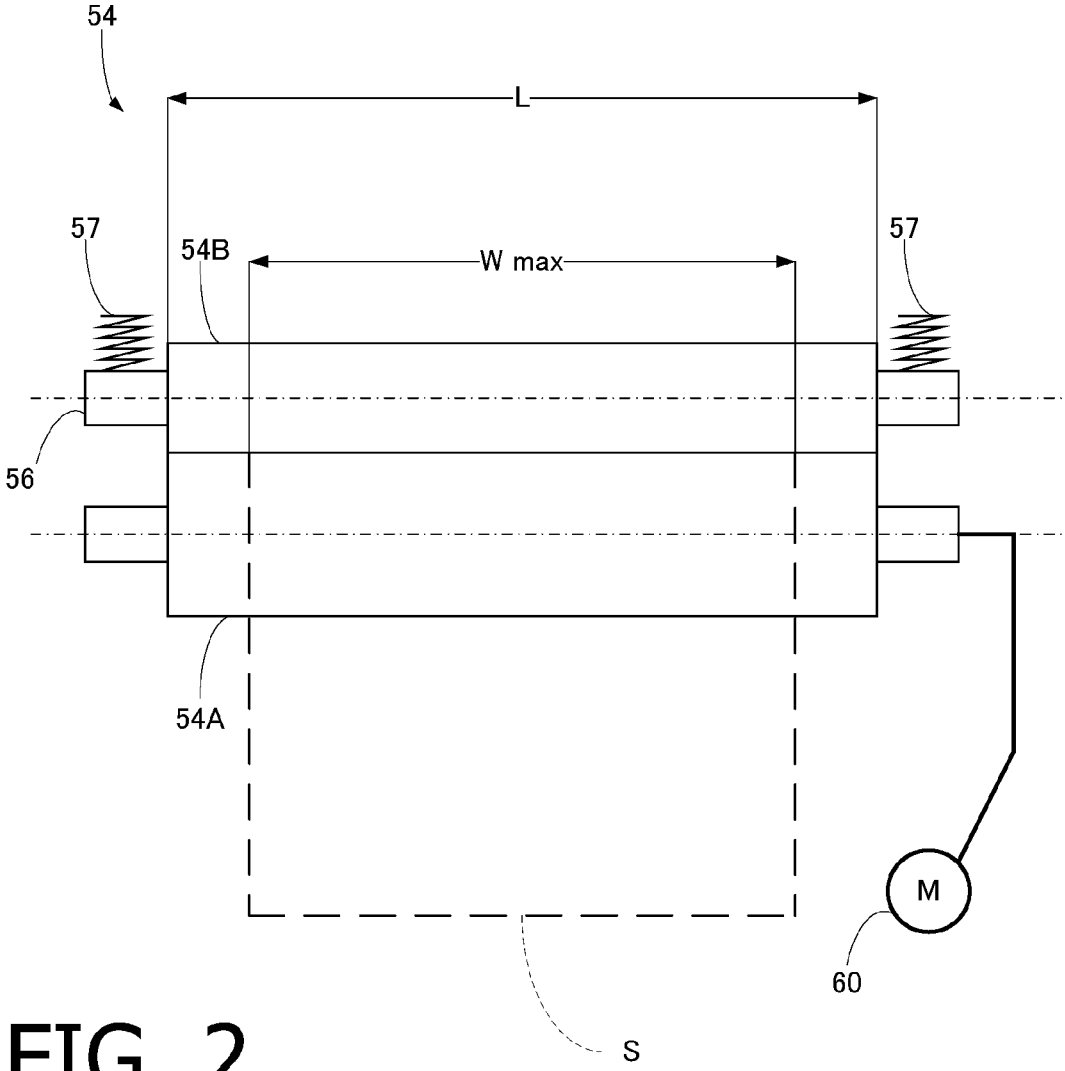

As shown in FIG. 2, the driving roller 54A and the driven roller 54B are configured such that a longitudinal length L of the roller portion is greater than a maximum width Wmax of the recording sheet S that can be used in the color printer 1. With this configuration, any recording sheet S used in the color printer 1 is fed with contacting the feed rollers 54 (i.e., the driving roller 54A and the driven roller 54B) over its width. Thus, the recording sheet S passed through the fixing unit 44 is cooled as it contacts the feed rollers 54.

The temperature of the recording sheet S immediately after passed through the fixing unit 44 is high, and releases water in the form of vapor. The water evaporation from the recording sheet S is suppressed by making the recording sheet S contact the feed rollers 54 to cool the recording sheet S.

When a toner image is transferred to the recording sheet S, the thickness of the toner image transferred on the recoding sheet S is effected by electrical resistance of the recording sheet S. The electric resistance of the recording sheet S is effected by the water contained in the recording sheet S. In order to maintain the thickness of the toner image substantially constant, it is necessary to maintain the amount of the water contained in the recording sheet S.

If the recording sheet S cooled by the feed rollers 54 as described above, a difference in the contained amounts of the water when the printing is executed on both sides can be made small. Therefore, a difference in image quality due to the contained water on both sides can be made small.

The driving roller 54A is made of rubber and directly, or indirectly (e.g., through a gear or the like) connected to the stepping motor 60 accommodated in the housing 2 and driven to rotate. The driven roller 54B is also made of rubber, rotatably supported by the cover 20. By springs 57, which are arranged at both end portions of a rotational shaft 56 of the driven roller 54B, the driven roller 54B is urged toward the driving roller 54A. With this configuration, when the driving roller 54A rotates, the driven roller 54B follows to rotate.

Figure 3:
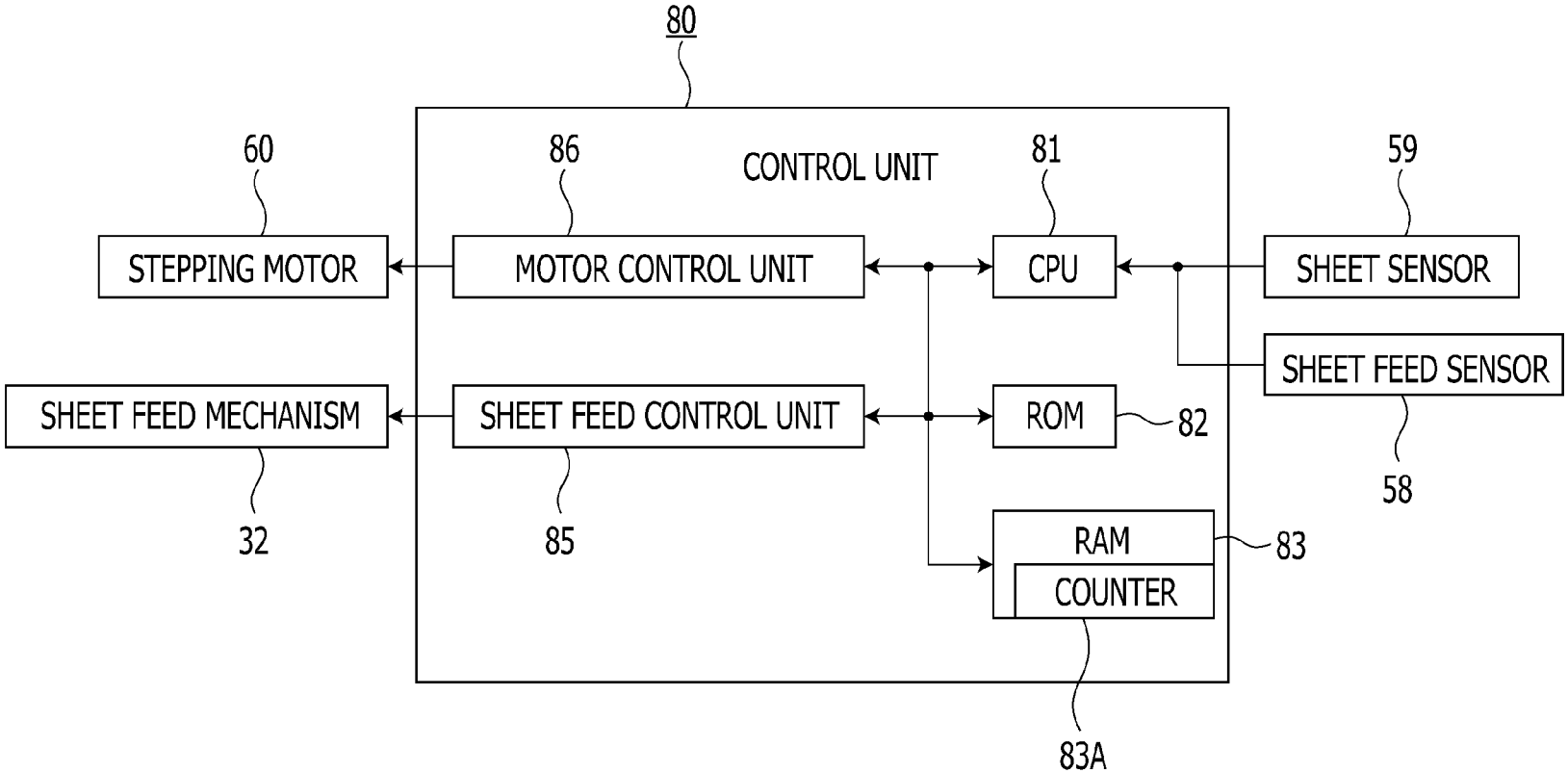
FIG. 3 is a block diagram showing a control system regarding a duplex printing of the image formation device according to the embodiment of the invention.

The color printer 1 has a control unit 80. The control unit 80 includes a CPU (central processing unit) 81, a ROM (read only memory) 82 and a RAM (random access memory) 83 (see FIG. 3). The CPU 81 controls the entire operation of the color printer 1 by executing various control programs. The ROM 82 stores various control programs necessary for controlling the operation of the color printer 1 and various types of data such as data tables. The RAM 83 is used for temporarily storing operation results, operational parameters and the like. According to the embodiment, a part of an area of the RAM 83 is used for a counter 83A.

The motor control unit 86 controls the stepping motor 60 to rotate. Specifically, the motor control unit 86 increments the counter 83A by one as the stepping motor 60 rotates by one step. The CPU 81 obtains accumulated number of steps for rotating the stepping motor after the counter 83A has been reset to zero by reading the value of the counter 83A.

The control unit 80 controls the sheet feed control unit 85 and the motor control unit 86. The sheet feed control unit 85 transmits a drive command to the sheet feed mechanism 32 based on the signal output by the CPU 81 to control the operation of the sheet feed mechanism 32.

The motor control unit 86 controls the driving operation of the stepping motor 60 by transmitting a driving pulse to the stepping motor 60 based on the control signal output by the CPU 81. The stepping motor 60 is one of drive sources when the printing operation is executed in the color printer 1.

The stepping motor 60 is a dedicated motor that drives the discharge roller 55 and the driving roller 54A. The motor control unit 86 controls the operation of the stepping motor 60, thereby controlling the operation of the discharge roller 55 and the driving roller 54A. It should be noted that the discharge roller 55 and the driving roller 54A can be driven, independently of other mechanisms in the color printer 1, to rotate in the forward direction and the reverse direction, and to accelerate or decelerate.

The other mechanisms (e.g., the sheet feed mechanism 32, the image formation unit 4, the fixing unit 44, the exposure unit 41, etc.) are driven by other motors, which are well known and will not be described in detail for brevity.

The control unit 80 is connected to a sheet feed sensor 58 and a sheet sensor 59. The CPU 81 controls the sheet feed operation in accordance with the outputs of the sheet feed sensor 58 and the sheet sensor 59.

Figure 4:
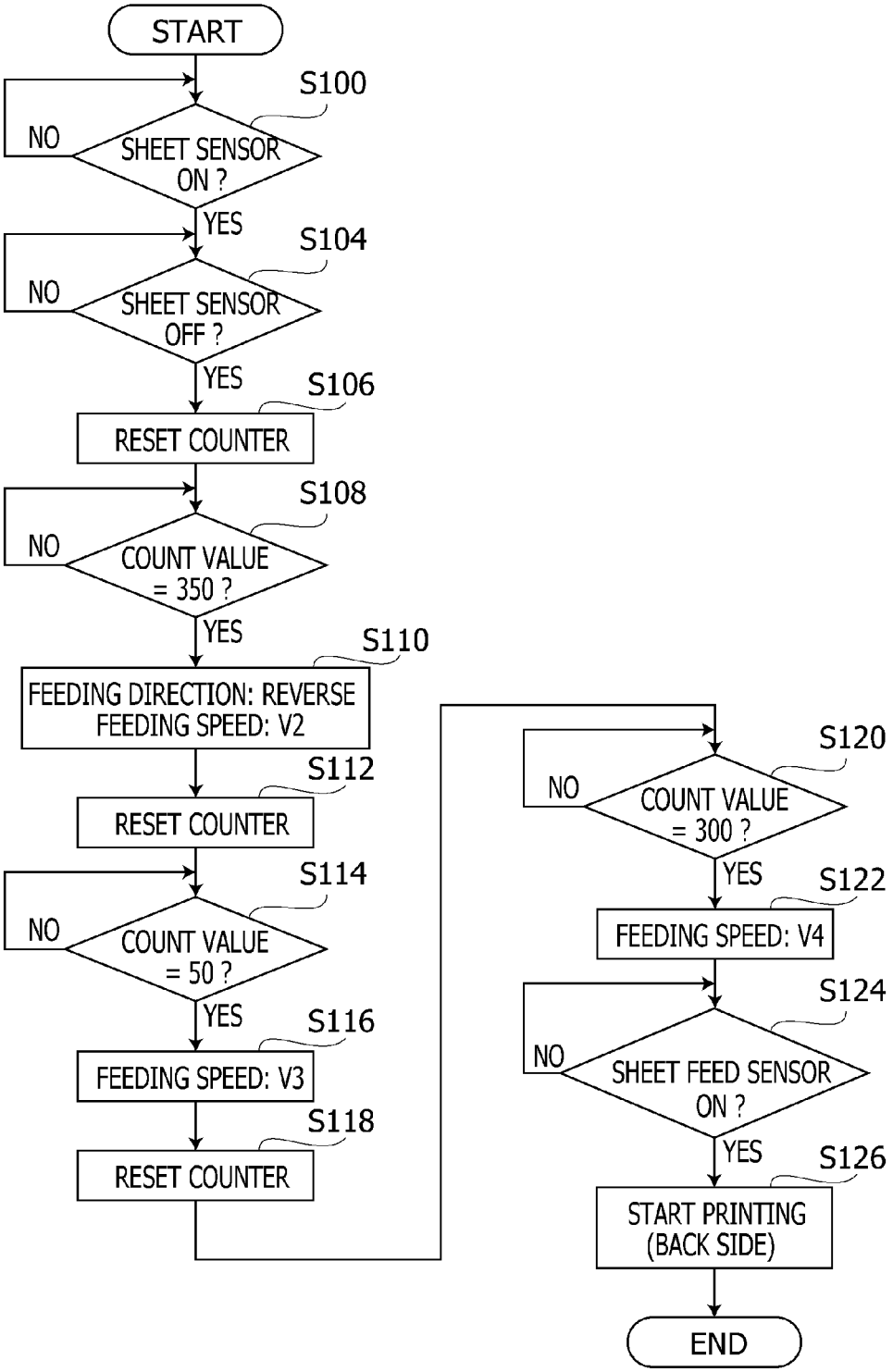
FIG. 4 is a flowchart of a duplex printing process according to the embodiment of the invention.

Next, a control program of the duplex printing will be described in detail, referring to a flowchart shown in FIG. 4.

The sheet sensor 59 is a sensor of which a status is OFF when the sheet sensor 59 does not detect a recording sheet S, while a status is ON when the recording sheet S is detected. The CPU 81 controls the image formation unit 4 to form an image on the recording sheet S with feeding the recording sheet S at a speed of V1. When the leading end (first end) of the recording sheet S on which the image is formed has passed through the fixing unit 44 and reached the sheet sensor 59, the status of the sheet sensor 59 turns from OFF to ON (S100: YES).

Then, the CPU 81 pauses until the trailing end (second end) of the recording sheet S has passes through the sheet sensor 59 and the status of the sheet sensor 59 turns from ON to OFF (S104: NO).

When the CPU 81 judges that the status of the sheet sensor 59 turns from ON to OFF (S104: YES), the CPU 81 resets the counter 83A (set the counter value to zero) (S106). After resetting the counter 83A, the CPU 81 pauses until the value of the counter 83A is 350 steps (S108), which means the CPU 81 pauses until the trailing end (second end) of the recording sheet S passes through the feed rollers 54.

When the CPU 81 judges the value of the counter 83A has reached 350 steps (S108: YES), the CPU 81 drives the discharge roller 55 and the driving roller 54A so that the feeding of the recording sheet S is once stopped. Thereafter, the CPU 81 drives the discharge roller 55 and the driving roller 54A such that the recording sheet S is fed in an opposite direction (i.e., in a direction in which the recording sheet S is introduced in the color printer 1) at the feeding speed of V2 (S110). According to the embodiment, the feeding speed V2 and the feeding speed V1 has a following relationship.

$$|V2|=1.3\times|V1|$$

Thus, the sheet feed speed is accelerated from V1 to V2.

Next, the CPU 81 resets the counter 83A (i.e., sets the value of the counter 83A to zero) (S112).

After resetting the counter 83A, the CPU 81 pauses until the value of the counter 83A is 50 steps (S114: NO), which means that the leading end (second end) of the recording sheet S fed at the speed of V2 passes through the feed rollers 54 and nipped by the feed rollers 54.

When the CPU 81 judges that the value of the counter 83A has reached 50 steps (S114: YES), the CPU 81 controls the discharge roller 55 and the driving roller 54A so that the recording sheet S is fed in a direction of introducing the recording sheet S in the reverse path 52 at the speed of V3 (S116). The speed V3 and the speed V1 have the following relationship.

$$|V3|=1.8\times|V1|$$

Thus, the feeding speed is accelerated from V2 to V3.

After setting the sheet feed speed to V3, the CPU 81 resets the counter 83A (S118). Then, the CPU 81 pauses until the value of the counter 83A becomes 300 steps (S120: NO). That is, after changing the sheet feed speed from V2 to V3, the CPU 81 pauses until the trailing end (first end) of the recording sheet S passes through the diverging point 61 and the recording sheet S is completely introduced in the reverse path 52. When the recording sheet S is introduced in the reverse path 52, the leading end (second end) of the recording sheet S is caught by a feed roller 54C which is driven by a motor different from the stepping motor 60, and is fed by the feed roller 54C and the driving roller 54A. After the trailing end (first end) of the recording sheet S has passed through the driving roller 54A, the recording sheet S is fed only by the feed roller 54C.

When the value of the counter 83A becomes 300 steps (S120: YES), the CPU 81 controls the feed roller 54C so that the recording sheet S is fed toward the sheet feed mechanism 32 at the speed of V4 (S122). The relationship between the speeds V4 and V1 is as follows.

$$|V4|=1.05\times|V1|$$

Thus, the sheet feed speed is decreased from V3 (1.8×V1) to V4 (1.05×V1).

Thereafter, the recording sheet S is fed by the feed roller 54C within the reverse path 52 at the speed of V4 and reaches the sheet feed sensor 58 provided to the sheet feed unit 3. The sheet feed sensor 58 is a sensor of which a status is OFF when a recording sheet S is not detected, while the status is ON when the recording sheet S is detected. The CPU 81 pauses until the leading end (second end) of the recording sheet S reaches the sheet feed sensor 58 and the status of the sensor 58 turns from OFF to ON (S124: NO).

When the CPU 81 judges that the sheet feed sensor 58 is turned ON, the CPU 81 controls the image formation unit 4 and starts an image formation process on a rear surface of the recording sheet S (S126).

As described above, the recording sheet S is firstly fed, with its first end being a leading end, to pass through the image formation unit 4 and the fixing unit 44, and an image is formed on a front surface. Then, the sheet feed rollers 54 and the discharge roller 55 are reversed and the recording sheet S is fed back and introduced in the reverse path 52. As a result, the recoding sheet S is directed to the image formation unit 4 and the fixing unit 44 in a reversed matter, with the second end being a leading end, so that the image is formed on the back surface.

Figure 6:
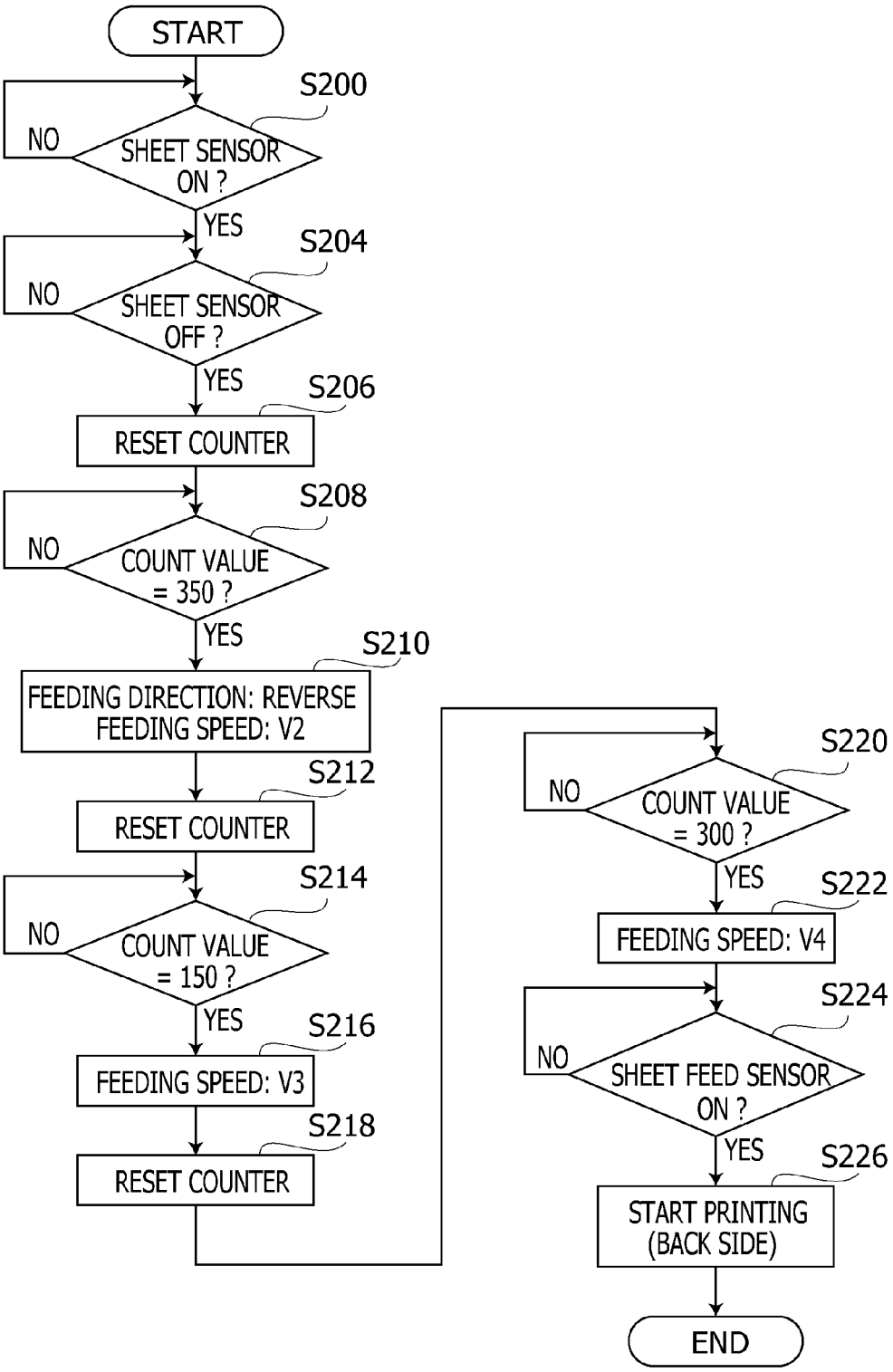
FIG. 6 is a flowchart of a duplex printing process according to a second embodiment of the invention.

According to the above-described embodiment, the recording sheet S passes through the feed path 51 and the sheet feed rollers 54 when fed in both directions. Hereinafter, a configuration where the recording sheet S does not passes through the feed path 51 and the sheet feed rollers 54 reciprocally. It should be noted that the operation of a second embodiment is substantially the same as that of the first embodiment except for the configuration of the discharge/reverse unit and control timing. Therefore, regarding the similar configurations, detailed description will not be given for brevity. Further, regarding the control timing, S214 of FIG. 6 is different from S114 in FIG. 4 in that the count value in S214 is 150 steps while the count value in S114 is 50 steps. The other portion of the flowcharts in FIGS. 4 and 6 are the same and the detailed description will not be given for brevity.

Firstly, a discharge/reverse unit 70 of the color printer 1 according to the second embodiment will be described.

The discharge/reverse unit 70 has a feed path 71, a reverse path 72, feed rollers 54 and a discharge roller 55.

The feed path 71 is a path that guides the recording sheet S discharged from the image formation unit 4 (fixing unit 44) to the discharge tray 22. As indicated by solid line in FIG. 5, the feed path 71 joins the reverse path 72 at a diverging point 62, which is located between the image formation unit 4 and the discharge tray 22.

The reverse path 72 is a path that guides the recording sheet S toward the image formation unit 4 when the duplex printing is executed. As indicated by solid line in FIG. 5, the reverse path 72 extends downward from the discharge tray 22, then extends frontward below the sheet feed tray 31, and joins the sheet feed unit 3.

The feed rollers 54 are arranged in the reverse path 72, and feed the recording sheet S reversely fed by the discharge roller 55 toward the image formation unit 4. It should be noted that components of the discharge/reverse unit 70 and given the same reference numerals as in the first embodiment are the same as those in the first embodiment and will not be described in detail for brevity.

Figure 5:
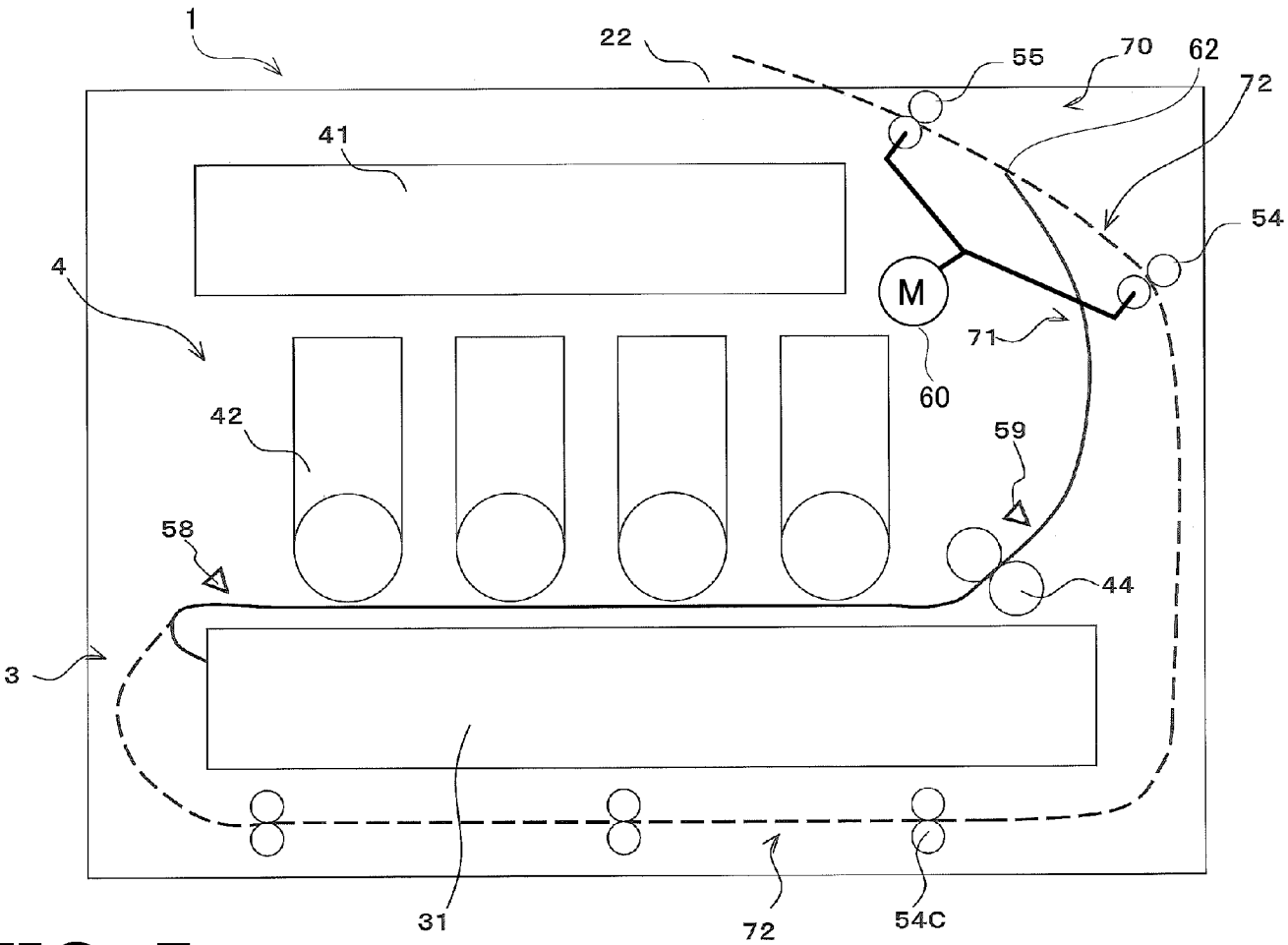
FIG. 5 is a cross sectional side view of an image formation device according to a second embodiment.

Next, control of the color printer 1, according to the second embodiment, when the duplex printing is executed will be described referring to FIGS. 5 and 6.

The CPU 81 forms an image on the front surface of the recording sheet S with controlling the image formation unit 4 to feed the recording sheet S at the speed of V1. When a leading end (first end) of the recording sheet S on which the image has been formed by the image formation unit 4 passes through the fixing unit 44 and reaches the sheet sensor 59, the CPU 81 detects that the status of the sheet sensor 59 is changed from OFF to ON (S200: YES). The CPU 81 pauses until the trailing end (second end) of the recording sheet S passes through the sheet sensor 59, and the status of the sheet sensor 59 turns from ON to OFF (S204: NO).

When the CPU 81 judges that the status of the sheet sensor 59 has changed from ON to OFF (S204: YES), the CPU 81 resets the counter 83A (set the value of the counter 83A to zero) (S206). After resetting the counter 83A, the CPU 81 pauses until the value of the counter 83A reaches 350 steps (S208). That is, the CPU 81 pauses until the trailing end (second end) of the recording sheet S passed through the sheet detection sensor 59 reaches the diverging point 62.

When the CPU 81 judges that the value of the counter has reached 350 steps (S208: YES), the CPU 81 once controls the discharge roller 55 and the driving roller 54A to stop feeding the recording sheet S. Then, the CPU 81 controls the discharge roller 55 and the driving roller 54A so that the recording sheet S is fed in a reversed direction (in a direction where the recording sheet S is introduced in the color printer 1) at the feeding speed of V2 (S210). The speeds V1 and V2 have the following relationship.

$$|V2|=1.3\times|V1|$$

Thus, the feeding speed is accelerated from V1 to V2.

After changing the feeding speed to V2, the CPU 81 resets the counter 83A to zero (S212). Thereafter, the CPU 81 pauses until the value of the counter 83A reaches 150 steps (S214: NO). That is, the CPU 81 pauses until the leading end (second end) of the recording sheet S which is fed at the speed of V2 passes through the feed rollers 54 and nipped thereby.

When the CPU 81 judges that the value of the counter 83A has reached 150 steps (S214: YES), the CPU 81 controls the discharge roller 55 and the driving roller 54A so that the recording sheet S is fed toward the feed roller 54C at the speed of V3 (S216). The speeds V3 and V1 have the following relationship.

$$|V3|=1.8\times|V1|$$

Thus, the speed is increased from V2 (1.3×V1) to V3 (1.8×V1).

After changing the sheet feed speed to V3, the CPU 81 resets the counter 83A to zero (S218). Then, the CPU 81 pauses until the value of the counter 83A reaches 300 steps (S220: NO). That is, the CPU 81 pauses, after changing the sheet feed speed from V2 to V3, till the leading end (second end) of the recording sheet S is nipped by the feed rollers 54C, the trailing end (first end) of the recording sheet S passes through the diverging point 62, and thus the recording sheet S completely enters the reverse path 72.

When the CPU 81 judges that the value of the counter 83A has reached 300 steps (S220: YES), the CPU 81 drives the driving roller 54A and the feed rollers 54C so that the recording sheet S is fed toward the sheet feed mechanism 32 at the speed of V4 (S222). The speeds V4 and V1 have the following relationship.

$$|V4|=1.05\times|V1|$$

Thus, the CPU 81 decreases the sheet feed speed from V3 (1.8×V1) to V4 (1.05×V1).

Thereafter, the recording sheet S is fed in the reverse path 72 by the feed rollers 54C and reaches the sheet feed sensor 58, which is provided to the sheet feed unit 3. The CPU 81 pauses until the leading end (second end) of the recording sheet S reaches the sheet feed sensor 58 and the status of the sheet feed sensor 58 is changed from OFF to ON (S224: NO).

When the CPU 81 judges that the feed sensor 58 is ON, the CPU 81 controls the image formation unit 4 to start forming an image on a back surface of the recording sheet S (S226).

After the image formation on the front surface is completed as the leading end (first end) has passed through the image formation unit 4 and the fixing unit 44, the feeding direction of the recording sheet S is reversed as the feed rollers 54 and the discharge roller 55 are reversed and the recording sheet S is fed in the reverse path 72. As a result, the recording sheet S of which image formation on the front surface has completed is fed toward the image formation unit 4 and the fixing unit 44 with the second end being the leading end and front/back surfaces are reversed, and an image is formed on the back surface. As described above, according to the color printer 1, by making the recording sheet S pass through the image formation unit 4 and the fixing unit 44 twice, the duplex printing is completed.

According to the color printer 1 as described above, effects as follows are achieved.

When the recording sheet S is reversely fed, the feeding speed is increased to V3 after the recording sheet S is caught by the feed rollers 54. Therefore, rapid increase of load when the leading end of the recording sheet S strikes the feed rollers 54 can be suppressed. With such a configuration, skew and/or folding of the leading end portion of the recording sheet S can be suppressed. Further, when a stepping motor is employed as in the above-described embodiment, step out of the stepping motor 60 can be suppressed.

Further, after the feeding direction is reversed, the feeding speed is increased from V1 to V2. With this configuration, load to the leading end of the recording sheet S when the leading end strikes the feed rollers 54 can be suppressed with the time period required for performing the duplex printing.

Furthermore, the feed rollers 54 are arranged to be inserted in the feed path 51 so that the feed rollers 54 feed the recording sheet S in the forward direction from the fixing unit 44 to the discharge unit 55, and in the reverse direction from the discharge roller 55 to the reveres path 52. According to the above configuration, discharge of the recording sheet S and re-feeding of the recording sheet S can be done with only one roller unit, which contributes in downsizing of the printer and simplifying the structure of the printer.

When a printer is configured such that a position where the recording sheet S is stopped and the position of the feed rollers 54 are close to each other, the printing speed when the duplex printing is performed can be accelerated if the above-described configuration is employed.

Since the recording sheet S is fed with contacting the feed rollers 54 over its width, the cooling effect can be achieved over the width of the recording sheet S, which improves the quality of the image formed on the recording sheet S.

According to the embodiment, the feed rollers 54 and the discharge roller 55 are driven by the same stepping motor 60, excessive tension or flexure of the recording sheet S when it is being fed can be prevented. Further, since only one motor is required to drive both the feed rollers 54 and the discharge roller 55, the structure of the printer can be simplified.

If relatively thick paper which exhibits strong elasticity or firmness is employed, the load to the leading end of the recording sheet when it strikes the roller increases. Thus, the configurations as described are advantageous when a firm paper is employed.

What is claimed:

1. An image formation device, comprising:

a housing formed with a discharge opening through which a sheet is discharged from the image formation device;

an image formation unit configured to form an image on the sheet;

a fixing unit configured to fix an image, which was transferred onto the sheet, on the sheet;

a sheet feed path which guides the sheet from the fixing unit to the discharge opening;

a sheet feed roller arranged in the sheet feed path;

a sheet discharge roller arranged at a position in the sheet feed path and between the discharge opening and the sheet feed roller;

a motor configured to drive the sheet feed roller and the sheet discharge roller;

a reverse path which diverges from a diverging point at a position in the sheet feed path between the sheet feed roller and the fixing unit; and a controller configured to:

control the motor to rotate the sheet feed roller and the sheet discharge roller in a first direction so that the sheet is fed from the fixing unit to the discharge opening at a first speed V1;

control the motor to rotate the sheet feed roller and the sheet discharge roller in a second direction so that the sheet is fed from the discharge opening to the diverging point at a second speed V2 if the sheet has entirely reached a discharge opening side of the diverging point; and change a feeding speed to a third speed V3 if the sheet has reached a position where it is nipped by the sheet feed roller after the sheet was started to be fed at the second speed V2, wherein the first speed V1, the second speed V2, and the third speed V3 have the following relationships, $$|V1|<|V2|<|V3|.$$

2. The image formation device according to claim 1, wherein the sheet feed roller includes a pair of rollers, and a longitudinal length of each of the pair of rollers is longer than a width of the sheet.

3. The image formation device according to claim 1, wherein the sheet feed roller includes a pair of rollers, which are made of rubber material.

4. The image formation device according to claim 1, wherein the motor is a stepping motor.

5. The image formation device according to claim 1, wherein the controller controls the feeding speed of the sheet such that the feeding speed of the sheet is changed to a fourth speed V4 if the sheet has entirely passed through the diverging point and entered the reverse path after the sheet was started to be fed at the third speed V3, and wherein the third speed V3 and the fourth speed V4 have the following relationship;

$$|V4|<|V3|.$$

6. The image formation device according to claim 1, wherein the fixing unit is configured to apply heat and pressure to the sheet.

7. The image formation device according to claim 1, wherein the controller comprises a processing unit and memory storing one or more control programs executable by the processing unit.

* * * * *